United States Patent [19]

Jerila

[11] Patent Number: 4,644,992

[45] Date of Patent: Feb. 24, 1987

[54] PIVOT BLOCK FOR BIFOLD DOORS

[75] Inventor: Torsti T. T. Jerila, West Covina, Calif.

[73] Assignee: Acme General Corporation, San Dimas, Calif.

[21] Appl. No.: 825,800

[22] Filed: Feb. 4, 1986

[51] Int. Cl.[4] ..... E05D 15/26

[52] U.S. Cl. ..... 160/213; 160/206; 16/DIG. 13; 52/823

[58] Field of Search ..... 160/213, 210, 206, 207, 160/201; 16/DIG. 13, 385; 52/823

[56] References Cited

U.S. PATENT DOCUMENTS

| | | | |
|---|---|---|---|
| 1,964,316 | 6/1934 | Ellison | 160/206 |
| 3,162,890 | 12/1964 | Brydolf | 160/206 |
| 3,221,804 | 12/1965 | Rudnick | 160/206 |
| 3,592,354 | 7/1971 | Nielsen | 16/DIG. 13 |
| 3,866,658 | 2/1975 | Smith | 160/206 |
| 3,987,837 | 10/1976 | Hewson | 160/206 |
| 4,296,791 | 10/1981 | Chaumat | 160/206 |
| 4,363,351 | 12/1982 | Eriksen | 160/213 |
| 4,386,646 | 6/1983 | Matyas | 160/206 |

OTHER PUBLICATIONS

Acme Series 4600 Mirror Bifold Doors, Sep. 1980.
Acme Fine Line Series 4400 Bifold Doors, Mar. 1985.

*Primary Examiner*—Reinaldo P. Machado
*Attorney, Agent, or Firm*—Christie, Parker & Hale

[57] ABSTRACT

Hardware for a bifold door includes stiles and rails fittable along the edges of a flat panel to form a door and four identical corner blocks for interconnecting the stiles and rails. Each corner block is generally rectangular and fits into a U-shaped channel in an adjacent stile and the U-shaped channel in an adjacent rail. A single hole extends through the block parallel to the stile and closer to one edge of the block than the opposite edge for receiving either a pivot or a guide, depending on the block's location on the assembled door. An orientation indicating marker on the exposed face of the block permits the four blocks to be identically oriented. When assembled to form a pair of doors, pivots are inserted into the holes in one of the pair of doors further from the edge of the door and guides are inserted into the holes nearer the edge of the other door to provide lead-off for smooth closing of the doors.

25 Claims, 4 Drawing Figures

PIVOT BLOCK FOR BIFOLD DOORS

BACKGROUND

This application is related to U.S. patent application Ser. No. 371,546, entitled Hardware For Panel Doors, filed Apr. 26, 1982, by Torsti T. T. Jerila. The subject matter of the application is hereby incorporated by reference.

A type of door that has become increasingly popular, particularly for closets and the like, is a so-called bifold door. In a typical opening, four door panels are used. Two of these panels are hinged together at each side of the opening. The panel nearer the jamb (referred to herein as the pivot door) may be pivoted at the top and bottom to support the full weight of both doors. The other panel further from the frame (referred to herein as the lead door) typically has guides at the top and bottom which run in a track to keep the edge of the door within the frame.

Thus, when the doors are closed both doors are in the plane of the frame. To open a pair of doors one pulls at the hinge line, causing the doors to "fold" relative to each other. As the doors open, the pivot door pivots adjacent the jamb and the hinge edge of the lead door swings outwardly as constrained by the hinges between the doors and the guides in the tracks.

A popular type of bifold door has a flat rectangular panel which may be a mirror, plywood, pressed board, or the like. A metal stile fits on each edge of the panel and a metal rail is positioned at the top and at the bottom of the panel. The stiles and rails are connected together at the corners of the panel by corner connectors or corner blocks which are typically connected to the stile and rail rather than to the panel. A pair of pivots may be inserted into a hole in each of a pair of the corner blocks on the pivot door and a pair of guides may be inserted into holes in a pair of the corner blocks on the lead door. Such an arrangement is described and illustrated in the aforementioned patent application.

Quite often one closes such a pair of bifold doors by pressing laterally on the doors at the hinge line. When the doors are properly mounted, such pressure will cause the guide on the lead door to move away from the jamb toward the closed position. To close solely by application of pressure at the hinge line, the doors should be mounted so that the lead door never moves to a position perpendicular to the plane of the frame. In fact, to operate properly the angle between the fully open lead door and track should be appreciably less than ninety degrees. One way of assuring that the lead door has adequate "lead-off" to close properly when the door is open is to connect the guide to a sliding spacer or to place a blocking spacer at the pivot to hold the edges of the doors apart. Thus, instead of the two doors meeting to be substantially parallel with each other, the edges are held apart so that the two door panels form a sharp V. This leaves the lead door with enough of an angle that lateral pressure at the hinge line will cause the doors to close.

This arrangement is not the most desirable for at least a couple of reasons. The additional spacers at the top and bottom are an element of cost that is preferably avoided. Further, by holding the doors apart, the pivot door is also prevented from reaching ninety degrees relative to the track and the effective width of the opening is noticeably reduced.

When wood frame doors or the like are used to make a bifold set, lead-off can be provided by placing the pivots a somewhat greater distance from the edge of the pivot door than the guides are placed from the edge of the lead door. As such a set of doors opens, the pivot door may swing through more than ninety degrees out of the plane of the frame, leaving the lead door at enough of an angle relative to the track that pressure at the hinge line will cause the doors to close.

Such an arrangement has not been entirely satisfactory for doors assembled from flat panels, stiles and rails, since a principal advantage of such doors is low cost due to commonality of parts. Thus, it is desirable to have top and bottom rails for both doors that are identical. It is also desirable to have corner connectors that are identical for all locations on the doors. For this reason it has been common to have symmetrical rails and corner connectors. Such symmetry usually requires use of spacers to provide lead-off for the doors.

One technique that has been employed for such panel doors employs a corner connector having two parallel holes into which either a pivot or guide can be inserted. This provides the appropriate lead-off, but some installation problems have been noticed.

The practice in this industry is to provide sets of hardware including stiles, rails, corner connectors, hinges, pivots and guides to assemblers. The assemblers acquire appropriate panels and assemble doors including such hardware. The doors are assembled without placing the pivots or guides in the holes in the corner connectors. Thus, the assembled doors are not "handed", that is, a pair of doors can be used in either the right or left side of a frame by inserting the pivots and guides into the appropriate holes. Surprisingly, a substantial number of mistakes are made by installers who place the guides and pivots in the wrong holes, resulting in doors that operate improperly. This can be corrected by rehanging the doors if noticed at the time of installation, however, it may require the installer to return, which is an unnecessary cost.

The problem of installers making mistakes in placing the pivots and guides in the wrong holes is not trivial. In one type of mirror door, corner blocks were adopted with two parallel holes in the block to recieve either a pivot or guide, as appropriate. A slot or pair of holes was provided in the rail so that both holes were exposed and the installer had to choose which hardware to put in each hole. Despite emphasis in instruction sheets of the importance of this choice, so many mistakes were made that this design was abandoned. It was replaced with a corner block having one symmetrically located hole and one hole was provided in each end of the rail. The installer couldn't make a mistake on the hardware spacing, but spacers are now needed to assure sufficient lead-off for the doors to operate properly.

In addition to the need for additional pieces of hardware and the narrowing of the door opening, it is desirable to use pivots and guides at different spacings from the edge of the door rather than spacers because the doors work better. The lead-off provided by placing the pivot further from edge than the guide gives smoother closing action than when lead-off is provided by spacers.

It is therefore desirable to provide hardware for bifold doors which is virtually foolproof for the installer so that errors in hanging the doors are almost automatically avoided. For economy it is important that the stiles, rails and corner connectors used in such hardware are identical to minimize costs of manufacture and inventory and to avoid mismatched sets of hardware.

BRIEF SUMMARY OF THE INVENTION

There is, therefore, provided in practice of this invention according to a presently preferred embodiment, hardware for assembly with a rectangular panel to form one panel of a pair of bifold doors. Such a hardware set includes four corner blocks, with each corner block being a generally flat, rectangular block that fits into a generally U-shaped channel in a rail and a generally U-shaped channel in a stile at the corner of a door, with one face of the block exposed at the inside of the door and the opposite face adjacent the door panel. A single hole extends through the block parallel to the exposed face with the hole being closer to one side of the block than the opposite side of the block. An orientation indicating marker on the exposed face assures that the four blocks are identically oriented upon assembly of such a door. In such a hardware set the rails are punched with two holes. One or the other of the holes in the rails aligns with the hole in the block at each edge of the door. Thus, since the holes are at different distances from the edge of the door, either a pivot or a guide can be inserted as appropriate. A position indicating marker on an edge portion of the block which may be hidden by a stile advises the installer whether to install a pivot or a guide. Because of the arrangement of the corner block, it becomes difficult for the installer to make an error in hanging the doors.

DRAWINGS

These and other features and advantages of this invention will be appreciated as it becomes better understood by reference to the following detailed description when considered in connection with the accompanying drawings wherein.

DESCRIPTION

A pair of doors for a bifold set are illustrated schematically in perspective in the position they would typically have on the work bench of the assembler of the doors from a hardware set. Schematic pivots and guides are illustrated exploded from the doors and it will be understood that these are usually inserted by the installer at the construction site. The hinges are also shown exploded from the doors for clarity. Each of the two doors has a flat panel 10, which in a typical embodiment is a glass mirror. The panel may be decorative laminate, plywood, pressed board or the like, in other embodiments. As illustrated, the doors are face down and the portion seen in FIG. 1 would typically be on the inside of a closet or the like.

Along each side edge of each door panel there is an identical stile 11. Typically each stile is a steel strip roll formed into a generally E-shaped cross section. The edge of the panel is inserted into one of the U-shaped channels of the stile. The other U-shaped channel is exposed at the back face of the panel.

Each door panel has a rail 12 at its top edge and an identical rail 12 its bottom edge. The rails are also steel strip roll formed into an E-shaped cross section. The edge of the panel is inserted into one of the U-shaped channels of the rail and the other U-shaped channel is exposed at the back of the door panel.

Typical E-shaped rails are stiles suitable for practice of this invention are described and illustrated in the aforementioned patent application. Other configurations of stile or rail may also be used in practice of this invention. For example, one mirror door system has a U-shaped stile cemented to the rear of the glass along each edge of the door. A U-shaped rail fits on the top or bottom of the glass with one edge in front of the glass and the other edge spaced from the back of the glass. Thus, a U-shaped channel is formed along each edge, and the top and bottom at the rear of the door. A corner block can fit into these U-shaped channels.

Figure 1:
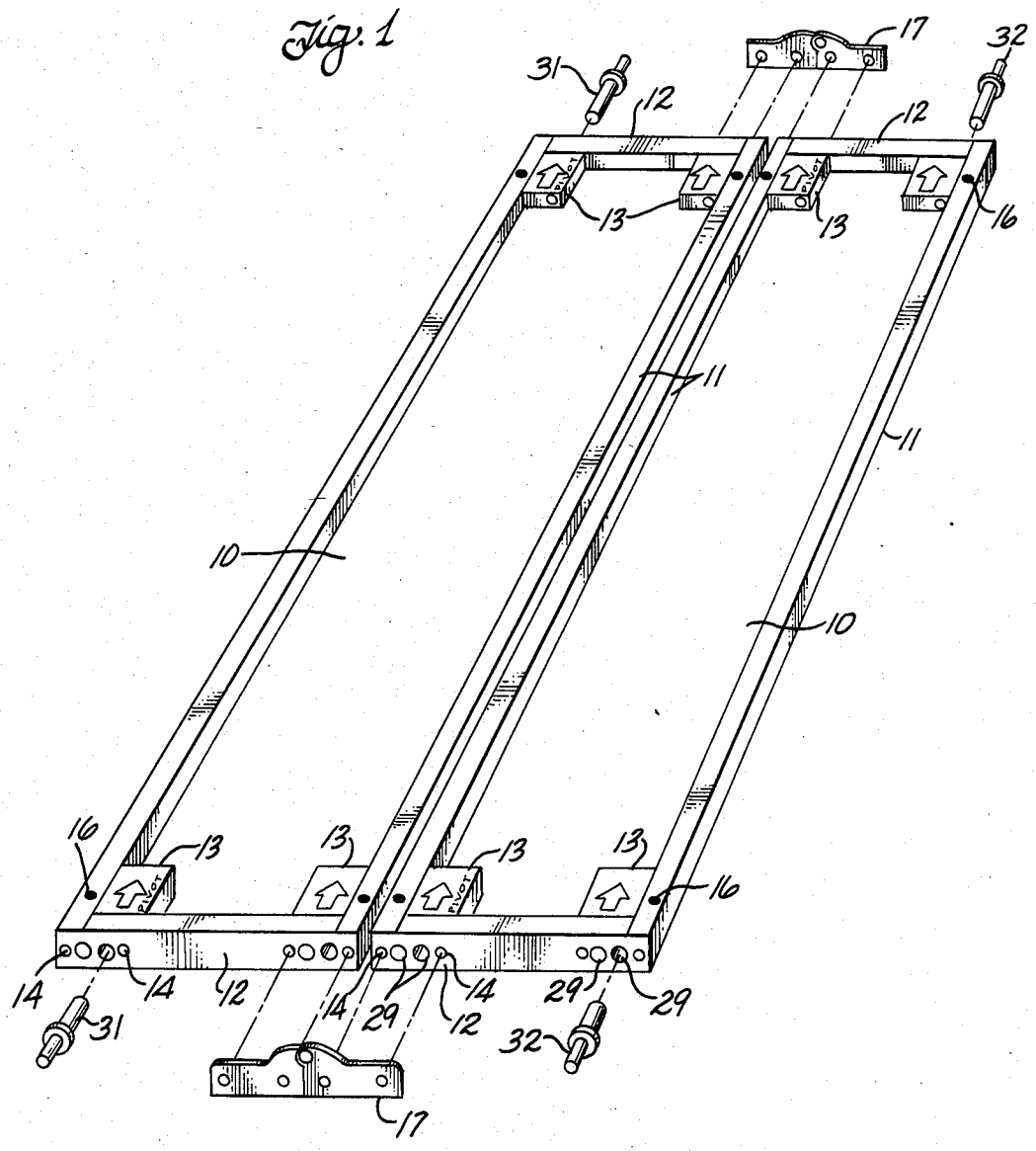
FIG. 1 illustrates in perspective and partly exploded, a pair of bifold doors constructed according to principles of this invention.

A corner block 13 is provided in each corner of a door panel. The eight corner blocks illustrated in FIG. 1 are identical. Such a corner block has edge portions that fit into the U-shaped channel in the rail and stile at the corner of the door. The corner block is secured to the rail by two self-tapping screws (not shown) extending through holes 14 through the face of the rail at the top or bottom of the door. Each corner block is secured to the adjacent stile by a self-tapping screw 16 extending through the back face of the stile. At least this much of a pair of doors is typically assembled before the doors are delivered to a construction site.

It is also customary for a pair of doors to be connected together by the assembler with hinges 17 at the block and rail also attach the hinge to the doors.

Figure 2:
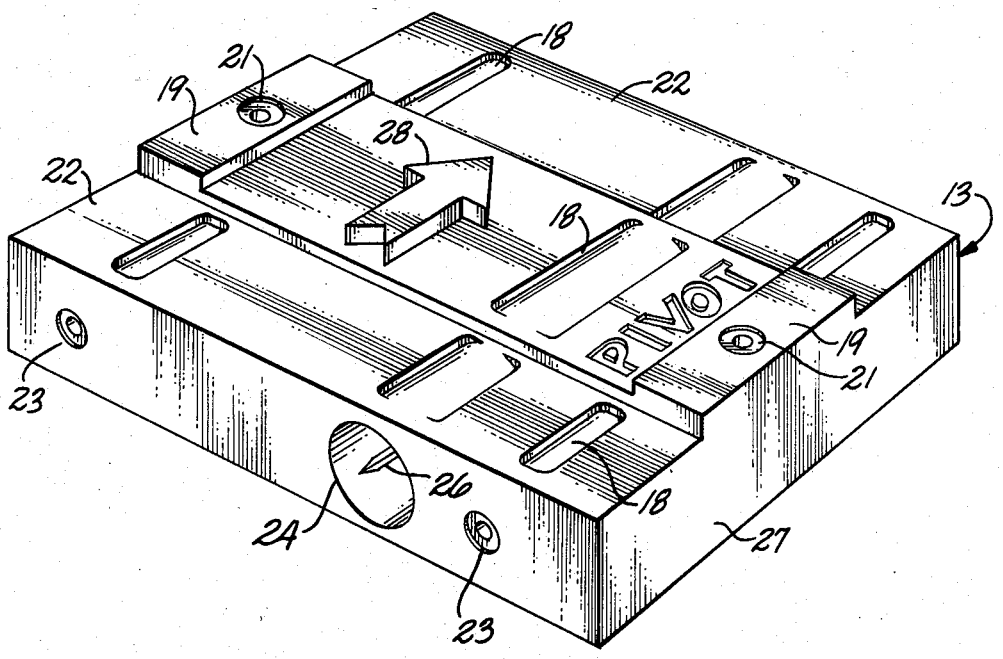
FIG. 2 illustrates in perspective a corner block for practice of this invention.

One of the corner blocks 13 is illustrated in FIG. 2. This drawing shows the face of the block that is exposed at the back of the door. The opposite face, hidden in FIG. 2, is also hidden during use since it is adjacent the door panel. The exposed face is generally flat. The hidden face has substantial recesses characteristic of injection molded parts. The corner block is preferably injection molded plastic and recesses are commonly used in such injection moldings so that the wall thickness of the finished product is reasonably uniform throughout. Exemplary recesses 18 for this purpose can also be seen on the generally flat exposed face of the block.

At each edge of the block there is a raised boss 19 on an edge portion that fits within the U-shaped channel of a stile. A countersunk screw hole 21 in the boss receives the screw that secures the stile and corner block. The hole through the stile for the screw is usually not countersunk when punched, but the screw head tends to pull the metal into the countersink in the corner block.

An edge portion 22 of the exposed face is somewhat recessed from the bosses 21 to fit in the U-shaped channel of a rail. A pair of screw holes 23 in the adjacent side face of the block receive the screws through the holes 14 which secure the block and rail. The opposite side face of the block, hidden in FIG. 2, also has a pair of screw holes in the same locations.

A hardware receiving hole 24 extends through the block parallel to the side faces that fit within the stile. Thus, when the block is in use on a door, the hole is vertical. Four ribs 26 extend longitudinally in the hole so that when a guide or pivot is inserted in the hole, the ribs tightly grip the body of the guide or pivot. In the preferred embodiment the hole 24 extends from face to face through the corner block, however, if desired coaxial blind holes could be provided from opposite sides of the block with a membrane between them. The height of such a block would be greater than an embodiment with a hole that extends clear through the block. The hole is placed asymmetrically so that it is nearer one of the side faces 27 that fits in a stile than it is the other side face (hidden in FIG. 2) that fits in a stile.

A raised arrow 28 is formed on the exposed face of the block on a portion of the face that is not hidden by a stile or rail when the block is installed on a door. The arrow provides an indication of the orientation of the block. The same face of the block also has recessed letters forming the word PIVOT on an edge portion of the block between the hole and the nearer side face 27. The word PIVOT is close enough to the edge of the face that it will be hidden when that edge of the block is inserted into the U-shaped channel of a stile. As will be apparent, this word provides an indication of the position of the block. If desired, the word GUIDE or other marker can be placed in the corresponding location on the face of the block between the arrow and the side face hidden in FIG. 2.

When the doors are assembled as illustrated in FIG. 1, the corner blocks are all oriented so that the arrows 28 all point in the same direction. This assures that all of the blocks are oriented identically.

Each of the rails has a pair of larger holes 29 punched through it between the screw holes 14 at each end of the rail. The hole 29 nearest the end of the rail is approximately the same distance from the edge of the assembled stile and rail as the hole 24 through the corner block is from the nearer side face 27 of the block. These distances are not quite identical to allow for thickness of the stile and a small gap intentionally left to accommodate normal size variations of the panel and hardware assembled on the panel. The other of the two holes 29 through the rail is about the same distance from the edge of the assembled stile and rail as the distance from the hole 24 through the corner block to the further side face of the block.

Thus, when a block is assembled in the corner between a stile and rail, the hole 24 through the block aligns with one and only one of the holes 29 through the rail. In the embodiment illustrated in FIG. 1 the corner blocks at the left edge of each panel are oriented so that the hole through the block aligns with the hole through the rail that is furthest from the end of the rail. Concomitantly, since the corner blocks are identically oriented, the hole through the corner block at the right of each door panel aligns with the hole through the rail that is nearer the end of the rail. When the installer receives the door, there are two holes in each end of a rail, but only one of these lines up with a hole in the corner block. The installer cannot insert the hardware in the wrong hole.

The word PIVOT is formed on the face of the block in an area that fits within the U-shaped channel of the stile at one edge of the door, the right edge as illustrated in FIG. 1. Thus, when the corner blocks are installed, the word PIVOT is exposed on the inside of the door at the left edge and is hidden by the stile at the right edge. In the position where the PIVOT shows, the hole in the block is further from the end of the rail. Where the word PIVOT is hidden by the stile, the hole through the block is nearer the end of the rail.

When the door is ready for installation, a pivot 31 (illustrated only schematically) is inserted into the hole further from the edge of the door in the corner blocks where the word PIVOT is exposed. A guide 32 (illustrated schematically) is inserted into the hole nearer the edge of the door in the corner blocks where the work PIVOT is concealed by the stile. The holes 29 through the rail are hidden by the hinges between the pair of doors and no hardware is inserted at that location.

The position indicating marker PIVOT on the block informs the installer which edge of the pair of doors should receive the pivot. Since there is only a single hole through the block there can be no error in positioning the pivot. Likewise, it is apparent that the guides should be inserted in the holes at the opposite edge of the door and since the only hole available is that nearer the edge, the guide is automatically properly positioned.

When the bifold doors are installed in the frame, one pair of doors is inverted relative to the other. This automatically places the pivots adjacent the jamb, with the lead doors nearer the center of the frame. Thus, when installed all of the arrows point upwardly on one pair of doors and all of the arrows point downwardly on the other pair of doors.

Figure 3A:
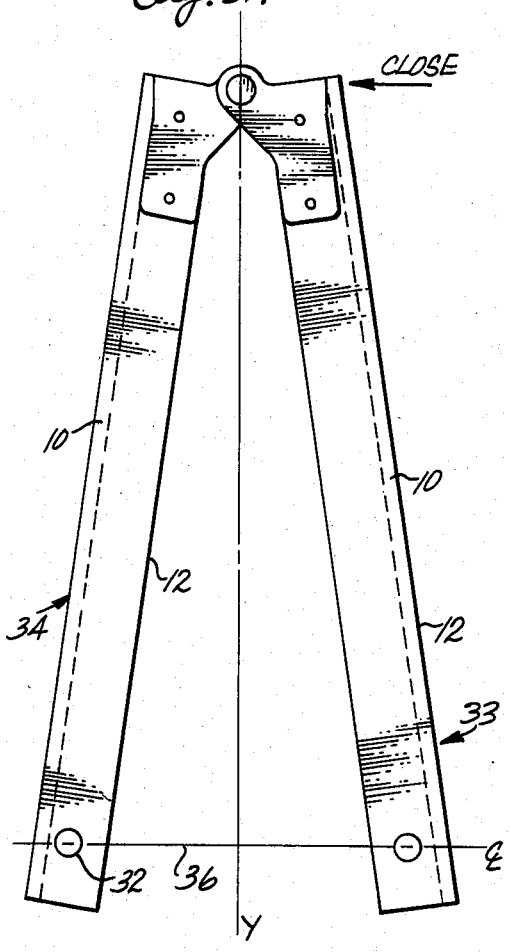
FIG. 3A illustrates schematically a pair of such doors in their open position.
Figure 3B:
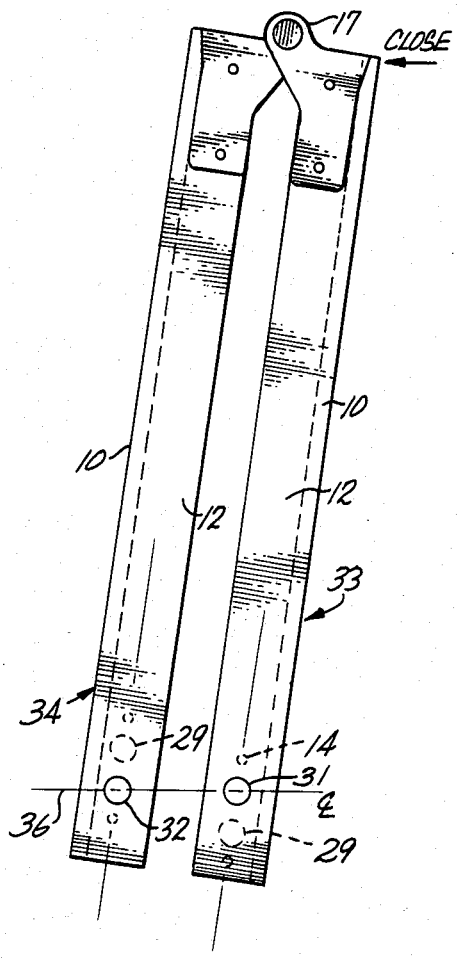
FIG. 3B illustrates schematically a pair of such doors in their close position.

FIG. 3 illustrates schematically the position of exemplary pairs of such doors when open. In the pair of doors illustrated in FIG. 3B, the pivot door 33 is mounted on a pivot 31 in a hole spaced further from the edge of the pivot door. The lead door 34 is constrained to move along the center line 36 of a track (not shown) by a guide 32 in a hole nearer the edge of the lead door. Because of the assembly hereinabove described with an asymmetrical corner connector, the pivot is automatically installed further from the edge of the pivot door than the guide is from the edge of the lead door.

Because of this, as the doors open the lead door never reaches an angle of ninety degrees from the center line of the track. The pivot door can, however, pivot through more than ninety degrees to the position illustrated. Because of the angle between the lead door and the track, lateral pressure on the doors at the hinge line will cause the doors to smoothly move toward the closed position. The asymmetry of the hole through the block and the concomitant spacing of the holes through the rail can be selected to provide the desired closing action for a particular width of door panel.

FIG. 3B illustrates an exemplary pair of bifold doors with the pivots and guides equally spaced from the edges of both the pivot and lead doors. In such an embodiment it is necessary to provide a spacer (not shown) between the guide and pivot to prevent the lead door from approaching and angle of ninety degrees relative to the center line of the track. This necessarily leaves the two doors at a substantial angle when fully opened, rather than being parallel as in the embodiment illustrated in FIG. 3B. There is a concomitant decrease in the width of the opening of the closet or the like.

Although but limited embodiments of corner block for bifold door hardware have been described and illustrated herein, many modifications and variations will be apparent to one skilled in the art. In the preferred embodiment the height of the corner block is small enough that the body of the pivot or guide pressed into the hole extends through more than half of the length of the hole through the block. Thus, if one chooses to have blind holes in opposite faces of the block, the total height of the block would be increased or the length of the guide and pivot decreased.

In the embodiment described, PIVOT is used as a marker for the position of the corner block in the assembly. As mentioned above, GUIDE may be used in addition to or in lieu of PIVOT to provide an indication of position. An arrow is preferred as a marker indicating the orientation of the corner block. Clearly the words on the block or other markers can be used for indicating orientation. The corner block has been described in an embodiment with E-shaped stiles and rails. Clearly such a structure may be used with other forms of stile and rail, if desired, such as the U-shaped rail and stile mentioned above. Many other variations will be apparent and it is therefore to be understood that this invention may be practiced otherwise than as specifically described.

What is claimed is:

1. A corner block for a bifold door comprising:

a generally flat, rectangular block having a sufficient thickness for fitting into a U-shaped channel of a rail and a U-shaped channel of a stile at the corner of a door with one face of the block exposed at the inside of the door and the opposite face adjacent a door panel;

a single hardware receiving hole extending through the block parallel to the exposed face, the hole being closer to one side of the block than the opposite side of the block, the block being symmetrical except for the locus of the hole; and means for securing the block to an adjacent rail and stile.

2. A corner block as recited in claim 1 further comprising an orientation indicating marker on the exposed face of the block.

3. A corner block as recited in claim 2 wherein the orientation marker indicates orientation of the block in a vertical direction.

4. A corner block as recited in claim 2 wherein the orientation indicating marker comprises an arrow parallel to the axis of the hole.

5. A corner block as recited in claim 2 further comprising a position indicating marker on the exposed face sufficiently close to one side of the face to be within such a stile.

6. A corner block as recited in claim 2 wherein the orientation indicating marker is asymmetrically located on the exposed face of the corner block.

7. A corner block for a bifold door having a flat panel, metal rails at the top and bottom of the panel, and metal stiles at each side edge of the panel, the block comprising:

a generally symmetrical rectangular plastic body having an exposed face, a hidden face opposite the exposed face for fitting adjacent the panel, a first side face, a second side face opposite the first side face, a top face and a bottom face;

a hole in the top face parallel to the side faces and nearer the first side face than the second side face for receiving door supporting hardware;

a hole in the bottom face parallel to the side faces and nearer the first side face than the second side face for receiving door supporting hardware;

means on the exposed face for distinguishing the top face from the bottom face; and means for connecting the corner block to an adjacent rail and stile.

8. A corner block as recited in claim 7 wherein the hole in the top face and the hole in the bottom face form a continuous hole through the corner block.

9. A corner block as recited in claim 7 comprising an edge portion adjacent to each side face for fitting into a generally U-shaped channel of a stile and including at least one screw hole for interconnecting the corner block and such a stile.

10. A corner block as recited in claim 9 comprising a position indicating marker on the exposed face in such an edge portion and sufficiently close to such a side face to be hidden by such a stile.

11. A corner block as recited in claim 9 comprising an edge portion adjacent to the top face and an edge portion adjacent to the bottom face for fitting into a generally U-shaped channel of a rail and including at least one screw hole for interconnecting the corner block and such a rail.

12. A corner block for a bifold door comprising:

a generally rectangular block having a first pair of opposite sides for fitting into a generally U-shaped channel in a door rail, a second pair of opposite sides perpendicular to the first pair of sides for fitting into a generally U-shaped channel in a door stile, an outer generally flat face perpendicular to the sides for exposure at one face of a door, and an inner face for facing a flat door panel;

a single hole extending through the block between the first pair of sides, the hole being parallel to the second pair of sides and closer to the one of the second sides than the other of the second sides; and an orientation indicating marker on a portion of the outer face outside such a U-shaped channel for aligning the corner blocks of a door in the same orientation in each corner of the door.

13. A corner block as recited in claim 12 further comprising:

a position indicating marker on a portion of the outer face between the locus of the hole and one of the second sides and sufficiently close to such second side to fit within the U-shaped channel of a door stile.

14. A corner block as recited in claim 13 wherein the block is substantially symmetrical except for the locus of the hole and the position indicating marker.

15. A corner block as recited in claim 12 wherein the block is substantially symmetrical except for the locus of the hole.

16. A bifold door system comprising a pivot door and a lead door, each of the doors comprising:

a flat rectangular panel;

a stile along each side edge of the panel, such a stile forming an inwardly facing, generally U-shaped channel at an inner face of the door along the side edge of the panel;

a rail at the top edge and a rail at the bottom edge of the panel, such a rail forming an inwardly facing, generally U-shaped channel at the inner face of the door along the respective edge of the panel, each rail having a pivot hole and a guide hole adjacent each end, the guide hole being nearer the end of the rail and the pivot hole being further from the end of the rail; and four identical rectangular corner blocks, each block having an edge portion in each of the U-shaped channels at a corner of the door, each of the corner blocks being identically oriented, each corner block comprising a vertically extending hole through the block and asymmetrically located relative to the vertical edges of the block so that the hole in each of a first pair of corner blocks aligns with a pivot hole in a rail and the hole in each of the other pair of corner blocks aligns with a guide hole in a rail.

17. A bifold door system as recited in claim 16 wherein each corner block comprises an orientation indicating marker on an exposed portion of the block for assuring identical orientation of the corner blocks.

18. A bifold door system as recited in claim 17 wherein:

the corner blocks along the bottom rails comprise a lower pivot block at the jamb edge of the pivot door, a hinge block at the hinge edge of each of the doors, and a lower guide block at the leading edge of the lead door;

the corner blocks along the top rails comprise an upper pivot block at the jamb edge of the pivot door, a hinge block at the hinge edge of each of the doors, and an upper guide block at the leading edge of the lead door; and further comprising:

hinge means connected to adjacent hinge corner blocks for pivotally interconnecting the pivot door and lead door;

a pivot in the hole in the lower pivot block and a pivot in the hole in the upper pivot block for pivotally supporting the doors; and a guide in the hole in the lower guide block and a guide in the hole in the upper guide block for guiding the leading edge of the lead door.

19. A bifold door system as recited in claim 1 comprising a position indicating marker on each corner block sufficiently close to one vertical edge to be within the U-shaped channel of such a stile.

20. Hardware for assembly with a flat rectangular panel to form a bifold door comprising:

a pair of stiles fittable along side edges of such a panel;

a pair of rails fittable along the top edge and bottom edge of such a panel, each rail having a pivot hole and a guide hole through a surface perpendicular to such a panel at each end of the rail, the guide hole being nearer the end of the rail and the pivot hole being further from the end of the rail; and four identical rectangular corner blocks, each block being fittable at a corner of the panel for interconnecting a stile and a rail, each corner block comprising a hardware receiving hole through the block and asymmetrically located relative to the sides of the block, and an orientation indicating marker on a face of the corner block for assuring identical orientation of the blocks.

21. Hardware as recited in claim 20 wherein the distance between the hole in the block and one edge of the block is approximately the same as the distance between a guide hole in a rail and the edge of the assembled stile and rail, and the distance between the hole in the block and the other edge of the block is approximately the same as the distance between a pivot hole in the rail and the edge of the assembled stile and rail.

22. Hardware as recited in claim 21 further comprising a pair of pivots each fittable into the hardware receiving hole in such a hole and a pair of guides each fittable into the hardware receiving hole in such a block.

23. Hardware as recited in claim 20 wherein each corner block comprises a position indicating marker asymmetrically located on a face of the block adjacent to one edge of the block.

24. Hardware as recited in claim 20 wherein:

each stile has a generally E-shaped cross section including a U-shaped channel fittable along the edge of such a panel and a U-shaped channel for receiving a corner block;

each rail has a generally E-shaped cross section including a U-shaped channel for receiving an edge of such a panel and a U-shaped channel for receiving such a corner block; and each corner block has a first pair of similar opposite edge portions fittable into the U-shaped channel of such a stile and a second pair of similar opposite edge portions fittable into the U-shaped channel of such a rail.

25. Hardware as recited in claim 24 wherein each corner block further comprises a position indicating marker on a face of the block sufficiently close to such an edge portion for fitting into the U-shaped channel of such a stile.

* * * * *